US009487842B2

(12) United States Patent
Das et al.

(10) Patent No.: US 9,487,842 B2
(45) Date of Patent: Nov. 8, 2016

(54) INJECTOR NOZZLE FOR QUENCHING WITHIN PIPING SYSTEMS

(71) Applicant: Phillips 66 Company, Houston, TX (US)

(72) Inventors: Sandipan Kumar Das, Owasso, OK (US); Steven Alan Treese, Katy, TX (US)

(73) Assignee: Phillips 66 Company, Houston, TX (US)

( * ) Notice: Subject to any disclaimer, the term of this patent is extended or adjusted under 35 U.S.C. 154(b) by 404 days.

(21) Appl. No.: 13/973,410

(22) Filed: Aug. 22, 2013

(65) Prior Publication Data

US 2014/0056098 A1 Feb. 27, 2014

Related U.S. Application Data

(60) Provisional application No. 61/692,805, filed on Aug. 24, 2012.

(51) Int. Cl.

| | |
|---|---|
| ***C21D 9/08*** | (2006.01) |
| ***B01F 5/04*** | (2006.01) |
| ***F28C 3/00*** | (2006.01) |
| *B01F 5/00* | (2006.01) |

(52) U.S. Cl.

CPC ..... *C21D 9/085* (2013.01); *B01F 5/0461* (2013.01); *F28C 3/00* (2013.01); *B01F 2005/0034* (2013.01)

(58) Field of Classification Search

CPC ..... B01F 5/0451; B01F 5/465; B01F 5/471; B01F 5/473; C21D 9/085

USPC ..... 366/158.5, 167.1, 173.2, 175.2, 181.5, 366/336–337; 261/76

See application file for complete search history.

(56) References Cited

U.S. PATENT DOCUMENTS

| | | | | |
|---|---|---|---|---|
| 1,734,164 | A * | 11/1929 | Faber | A62C 5/002 169/15 |
| 2,392,542 | A * | 1/1946 | Matuszak | B01F 3/0857 366/169.2 |
| 3,966,174 | A * | 6/1976 | Deve | B01F 5/246 164/158 |
| 4,812,049 | A * | 3/1989 | McCall | B01F 5/0451 261/76 |
| 5,452,955 | A * | 9/1995 | Lundstrom | B01F 3/0861 137/888 |
| 6,082,713 | A * | 7/2000 | King | B01F 5/0451 261/79.2 |
| 6,422,735 | B1 * | 7/2002 | Lang | B01F 3/0873 366/162.4 |
| 6,427,671 | B1 * | 8/2002 | Holze | B01F 5/045 123/568.17 |
| 8,033,714 | B2 * | 10/2011 | Nishioka | B01D 53/8631 137/888 |
| 8,342,486 | B2 * | 1/2013 | Smith | B01F 5/0618 261/76 |
| 2010/0226198 | A1 * | 9/2010 | Kapila | B01F 3/0865 366/158.5 |

* cited by examiner

*Primary Examiner* — David Sorkin
*Assistant Examiner* — Abbas Rashid
(74) *Attorney, Agent, or Firm* — Phillips 66 Company

(57) ABSTRACT

An injection system may include a first hollow pipe through which a first fluid flows and a second hollow pipe through which a second fluid flows, the first fluid for mixing into the second fluid. The second hollow pipe may reside through a wall of the first hollow pipe and have an opening near its end that is near a centerline of the first hollow pipe. A longitudinal baffle may reside within the second hollow pipe and together with the second hollow pipe, define a first and second baffle flow path within the second hollow pipe for the second fluid. A transverse baffle may be attached to the longitudinal baffle to protrude into the opening of the second hollow pipe. The transverse baffle divides the opening into a first baffle flow outlet and a second baffle flow outlet, for the first baffle flow path and the second baffle flow path.

13 Claims, 9 Drawing Sheets

INJECTOR NOZZLE FOR QUENCHING WITHIN PIPING SYSTEMS

CROSS-REFERENCE TO RELATED APPLICATIONS

This application is a non-provisional application which claims benefit under 35 USC§119(e) to U.S. Provisional Application Ser. No. 61/692,805 filed Aug. 24, 2012, entitled INJECTOR NOZZLE FOR QUENCHING WITHIN PIPING SYSTEMS, which is incorporated herein in its entirety.

STATEMENT REGARDING FEDERALLY SPONSORED RESEARCH OR DEVELOPMENT

None.

FIELD OF THE INVENTION

This invention relates to injection nozzles for piping systems.

BACKGROUND OF THE INVENTION

Piping systems in a variety of industrial settings are used to transport liquids and gases over a broad range of temperatures. In such piping systems, mixing of fluids of two different fluid streams may be necessary. In one example piping system, a first fluid at a first temperature in a first pipe may be continuously mixed with a second fluid at a second temperature in a second pipe to achieve a prescribed or desired mixing effectiveness. The temperature difference between the first fluid and the second fluid may be relatively large, and in some situations, mixing may actually be an injection of the first fluid in the first pipe into the second fluid in the second pipe. Because of the relatively large temperature differential that may exist between the first fluid and the second fluid, when such mixing or injecting occurs, a large temperature differential may be created within the pipe wall of the pipe receiving the injection of fluid. A relatively large temperature differential may result in unnecessary pipe repairs or replacements due to thermal stressing of the metal from which the pipe is constructed. To prevent the pipe wall of the pipe receiving the fluid injection from experiencing relatively large temperature fluctuations, improvement is needed. What is needed then is a device and method that permits maintaining a relatively small or no temperature differential along pipe wall sections in pipes that receive fluid injections at and near the location of the injections, without compromising mixing effectiveness of an injected fluid into a receiving fluid.

BRIEF SUMMARY OF THE DISCLOSURE

An injection system may include a first hollow pipe for carrying, directing or containing a first fluid, and a second hollow pipe for carrying, directing or containing a second fluid. The second hollow pipe passes through a wall of the first hollow pipe to approximately a centerline of the first hollow pipe. The second hollow pipe may have an end cap that protrudes beyond the centerline of the first hollow pipe. The second hollow pipe may define an outlet in a sidewall to permit the second fluid to flow from the second hollow pipe and into the first fluid. A longitudinal baffle may reside within the second hollow pipe. The longitudinal baffle within the second hollow pipe may extend through the wall of the first hollow pipe to beyond a centerline of the first hollow pipe. The longitudinal baffle may divide the first fluid into a first baffle flow (e.g. a flowing fluid) and a second baffle flow (e.g. a flowing fluid). The injection system may further include a transverse baffle that is attached to the longitudinal baffle. The transverse baffle may be arcuate and may protrude into the outlet. The transverse baffle may have a partial peripheral profile that is the same as a peripheral profile of the first hollow pipe. The transverse baffle may divide the opening (i.e. the outlet) into a first baffle flow outlet for the first baffle flow and a second baffle flow outlet for the second baffle flow. An area of the first baffle flow outlet may be 70 percent of the opening and an area of the second baffle flow outlet may be 30 percent of the opening.

An injection system may include a first hollow pipe through which a first fluid flows, and a second hollow pipe through which a second fluid flows. The second hollow pipe may define an opening proximate an end of the second hollow pipe. The second hollow pipe may reside through a wall of the first hollow pipe with the opening residing proximate a centerline of the first hollow pipe. A longitudinal baffle may reside within the second hollow pipe that defines a first baffle flow path and a second baffle flow path within the second hollow pipe for the second fluid. The injector system may further include a transverse baffle attached to the longitudinal baffle that divides the opening into a first baffle flow outlet and a second baffle flow outlet. An area of the first baffle flow outlet is 70 percent of the opening and an area of the second baffle flow outlet is 30 percent of the opening. The transverse baffle may further define two surfaces that are parallel to each other and that are perpendicular to surfaces of the longitudinal baffle. An end cap may enclose the end of the second hollow pipe. The first baffle flow path may reside between the end cap and the longitudinal baffle.

An injection system may include a first hollow pipe through which a first fluid flows, and a second hollow pipe through which a second fluid flows. The second hollow pipe may define an opening proximate an end of the second hollow pipe. The second hollow pipe may reside through a wall of the first hollow pipe with the opening residing proximate a centerline of the first hollow pipe. A longitudinal baffle residing within the second hollow pipe may define a first baffle flow path and a second baffle flow path within the second hollow pipe for the second fluid. A transverse baffle attached to the longitudinal baffle may divide the opening into a first baffle flow outlet and a second baffle flow outlet. An area of the first baffle flow outlet is greater than 50 percent of an area of the opening and an area of the second baffle flow outlet is less than 50 percent of the area of the opening. A first baffle flow (i.e. a fluid flow path) flows along a first side of the longitudinal baffle and the second baffle flow (i.e. a fluid flow path) flows along a second side of the longitudinal baffle, and the transverse baffle further defines two surfaces that are parallel to each other and that are perpendicular to surfaces of the longitudinal baffle. An end cap may enclose the end of the second hollow pipe. The first baffle flow path resides between the end cap and the longitudinal baffle. The transverse baffle has a partial peripheral profile that is the same as a peripheral profile of the first hollow pipe.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present teachings, inventive features and concepts, although presented in conjunction with FIGS. 1-12, may be manifested in other arrangements and the scope of the invention is not limited to the embodiments described or illustrated. The scope of the invention is intended only to be limited by the scope of the claims that follow.

Figure 1:
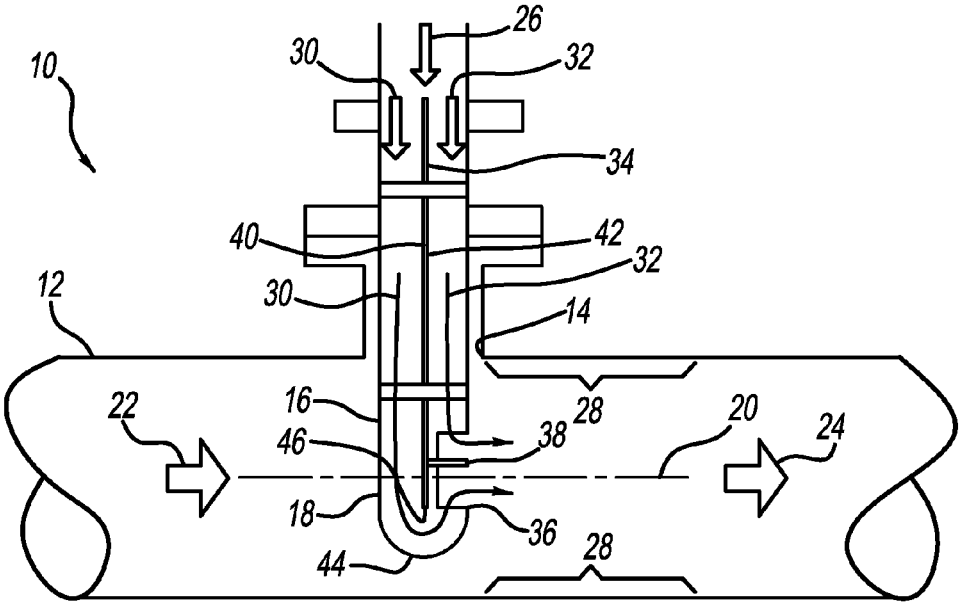
FIG. 1 is a side view of an injector nozzle and main pipe arrangement depicting a co-current injection arrangement of the injector nozzle with the flow within the main pipe.
Figure 2:
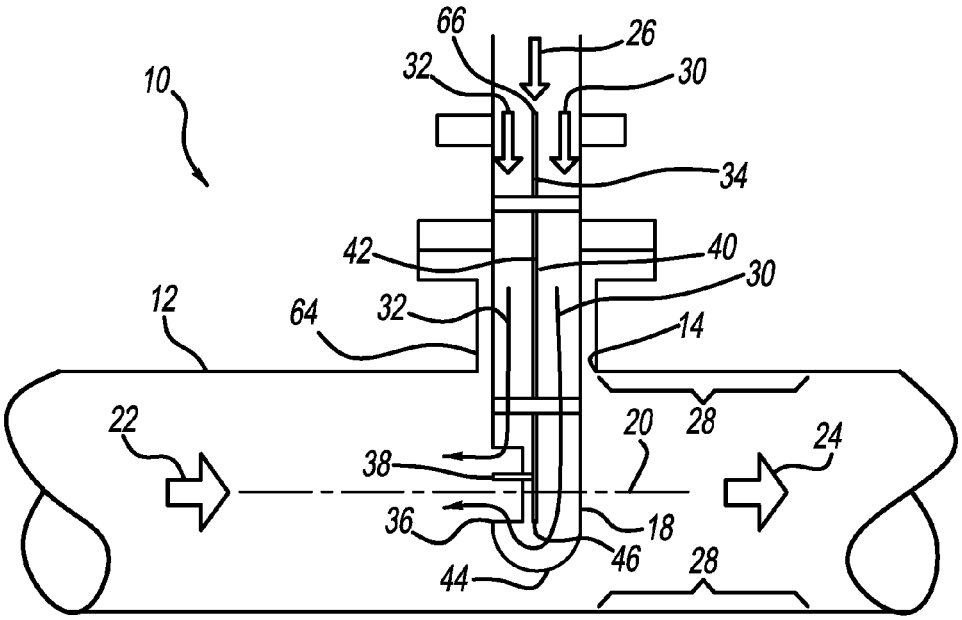
FIG. 2 is a side view of an injector nozzle and main pipe arrangement depicting a counter-current injection arrangement of the injector nozzle with the flow within the main pipe.

FIG. 1 and FIG. 2 depict an injection system 10 in which a first hollow pipe, also known as a main pipe 12, has an outer surface that defines a hole 14 through which a second hollow pipe, also known as an injector pipe 16, passes so that an end 18 of injector pipe 16 resides proximate a longitudinal centerline 20 of main pipe 12. Main pipe 12 is referred to as a main pipe because it carries a fluid 22, such as a vaporous gas, within its hollow portion. The overall diameter of main pipe 12 may be larger than that of injector pipe 16. Injector pipe 16 may be employed in situations that may include: quenching in-line between hydro-processing reactors, mixing hot vapor bypass fluids into cold fluids from a heat exchanger, mixing cold vapor bypass fluids into hot fluids from a heat exchanger, or mixing at any location where a smaller, primarily vapor stream needs to be mixed into a larger, primarily vapor stream. Using injector pipe 16 during in-line injection of a fluid 26, which may be a vapor, into a larger diameter pipe 12 into fluid 22, which may be vapor or a mixed stream such as a liquid and vapor, may occur when there is a relatively large or significant temperature differential, such as greater than 100 degrees Fahrenheit. When there is a temperature differential of 150-200 degrees Fahrenheit, employing an injection system 10 as depicted in FIGS. 1 through 7 may be beneficial, as will be discussed. As depicted in FIG. 1 and FIG. 2 in accordance with the present teachings, a nominal diameter of main pipe 12 is larger than a nominal diameter of injector pipe 16.

In one example of employing injector pipe 16, fluid 24 that flows downstream of injector pipe 16 will be cooled to a lower temperature than fluid 22, which is upstream of injector pipe 16. However, a challenge of using injector pipe 16 in any injection situation is to ensure that limited cooling or impingement of main pipe 12 occurs during injection. That is, no thermal impingement should occur, such as at interior wall area 28 downstream of injector pipe 16. A constant or nearly constant temperature at interior wall area 28 of main pipe should be maintained to prevent or limit thermal cycling of material of main pipe 12. A desired effect accomplished with the present teachings is to promote gradual mixing of the fluid of injector pipe 16 into main pipe 12 that causes a temperature change axially downstream of injector pipe 16 within main pipe 12 without causing undesired, large temperature differentials in main pipe 12, either axially or radially. Sudden or gross temperature changes in main pipe 12 are avoided with the present teachings.

To eliminate or greatly reduce impingement and its effects on main pipe 12, from injection by injector pipe 16, fluid 26 may be divided into a first baffle flow 30 and a second baffle flow 32 by a longitudinal baffle 34. Within injector pipe 16, longitudinal baffle 34 may extend past an outlet 36, also referred to as an opening, of injector pipe 16. A transverse baffle 38 may be fixed to longitudinal baffle 34 by a weld. When first baffle flow 30 flows along a first side surface 40 of longitudinal baffle 34 and a second baffle flow 32 flows along a second side surface 42 of longitudinal baffle 34, because transverse baffle 38 is fixed to longitudinal baffle 34, first baffle flow 30 is directed out of outlet 36 of injector pipe 16 on a first side 40 of transverse baffle 38 and second baffle flow 32 is directed out of outlet 36 of injector pipe 16 on a second side 42 of transverse baffle 38. Injector pipe 16 may have an end cap 44 to facilitate first baffle flow 30 in being directed completely around a tip end 46 of longitudinal baffle 34 to a first side of transverse baffle 38 to exit via outlet 36. End cap 44 may be arcuate, curved, or contoured on an interior surface to facilitate smooth flow of first baffle flow 30 of fluid 26 around tip end 46 of longitudinal baffle 34 within injector pipe 16. End cap 44 may be attached to injector pipe 16 by welding.

Figure 3:
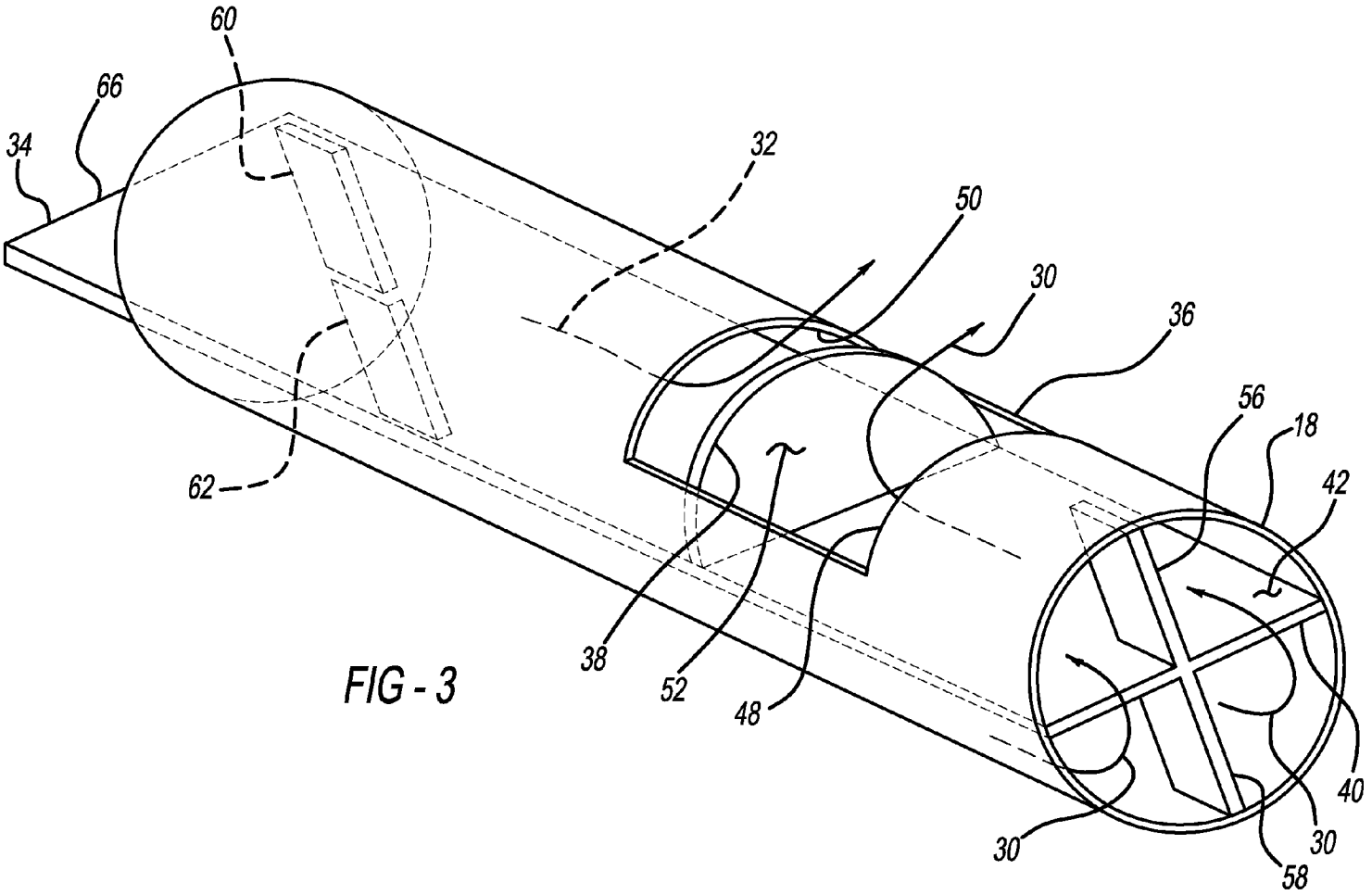
FIG. 3 is a perspective view of the injector nozzle removed from the main pipe, with the injector nozzle end cap removed.

FIG. 3 is a perspective view of injector pipe 16 without end cap 44. As depicted, transverse baffle 38 may be attached to and protrude from longitudinal baffle 34 so that transverse baffle 38 protrudes into outlet 36 and divides outlet 36 into two smaller outlets, a first baffle flow outlet 48 and a second baffle flow outlet 50. As depicted, transverse baffle 38 may have a curved periphery 54 so that it has the same radius of curvature as an outer surface or curved periphery of injector pipe 16. An advantage of such a structure may be a more consistent or predictable airflow around and over an exterior surface of injector pipe 16, whether or not injector pipe 16 is discharging fluid from first baffle flow outlet 48 and a first baffle flow outlet 50. Also, transverse baffle 38 may have a curved periphery 54 to permit easy insertion into, and removal from, injector pipe 16. Such insertion and removal may be from an end of injector pipe 16, such as an end employing end cap 44 with end cap 44 removed (see FIG. 3), or from the opposite end of main pipe 12 that employs end cap 44. Flat surface 52 of transverse baffle 38 that faces toward end 18 of injector pipe 16 may form a ninety degree angle with side surface 42 and side surface 40 of longitudinal baffle 34. Flat surface 52 of transverse baffle 38 may form an angle other than ninety degrees with side surface 42 and side surface 40 of longitudinal baffle 34. Centering guide 56 and centering guide 58 may be separate pieces or a single piece and may be located at end 18 within injector pipe 16 and may be used to position longitudinal baffle 34 within injector pipe 16. Similarly, centering guide 60 and centering guide 62 may be separate pieces or a single piece and may be located proximate to an end 66 of injector pipe 16 yet outside of main pipe 12 and may be used to position longitudinal baffle 34 within injector pipe 16.

Figure 4:
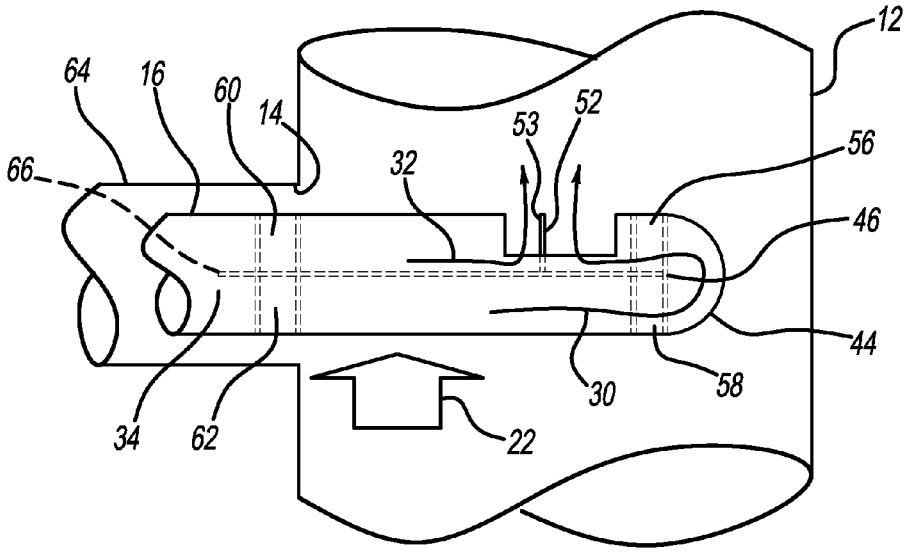
FIG. 4 is an enlarged side view of an injector nozzle and main pipe arrangement depicting a co-current injection arrangement of the injector nozzle with the flow within the main pipe.
Figure 5:
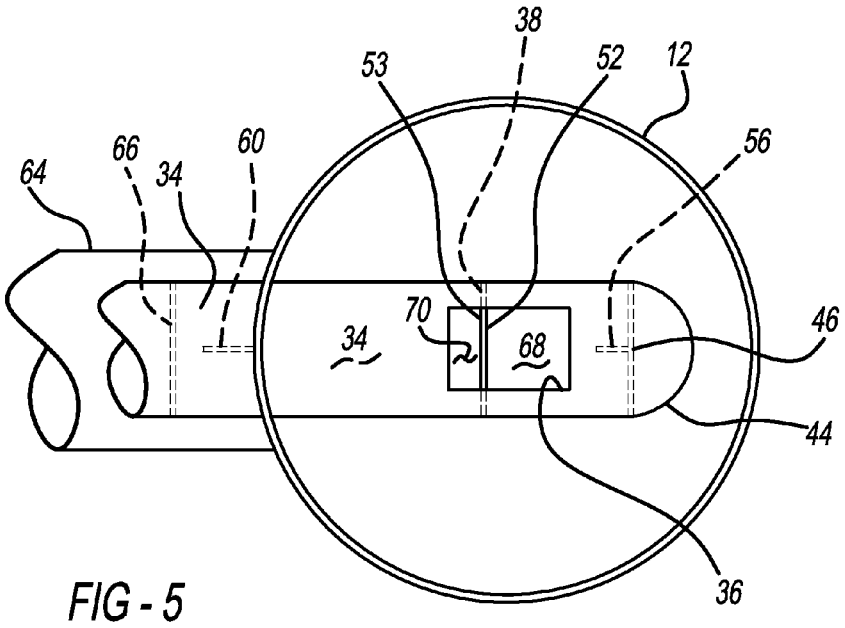
FIG. 5 is an enlarged side view of an injector nozzle and main pipe arrangement depicting a co-current injection arrangement of the injector nozzle with the flow within the main pipe.

FIG. 4 and FIG. 5 are both enlarged side views of injector pipe 16 arranged within main pipe 12 with outlet 36 pointed in a downstream direction relative to fluid 22, which is an alternate arrangement of injector pipe 16 within main pipe 12, relative to FIG. 2. Although, outlet 36 is directed in a co-current arrangement with fluid 22 of main pipe 12, the structure of injector pipe 16 may be the same as in FIGS. 1 and 2. That is, first baffle flow 30 and second baffle flow 32 may be divided by longitudinal baffle 34 to cause first baffle flow 30 to strike surface 52 of transverse baffle 38 and second baffle flow 32 to strike a surface 53 of transverse baffle 38, before both flows 30, 32 exit via outlet 36. Longitudinal baffle 34 may be welded to centering guides 56, 58, 60, 62, which may be welded to an outside wall that defines an outer shell or periphery of injector pipe 16. Longitudinal baffle 34 has a tip 66 at a first end that resides within a flanged branch 64 that branches from main pipe 12 and surrounds injector pipe 16.

FIG. 5 depicts how transverse baffle 38 may divide an area of outlet 36 into a two distinct areas, a first baffle flow outlet 68 and a second baffle flow outlet 70. To produce a desired effect, areas of outlets 68, 70 may be altered or changed by changing a position of transverse baffle 38 within outlet 36, whose area effectively equals that of combined areas of outlets 68, 70. The area that transverse baffle 38 itself occupies within outlet 36 may be taken into consideration.

Figure 6:
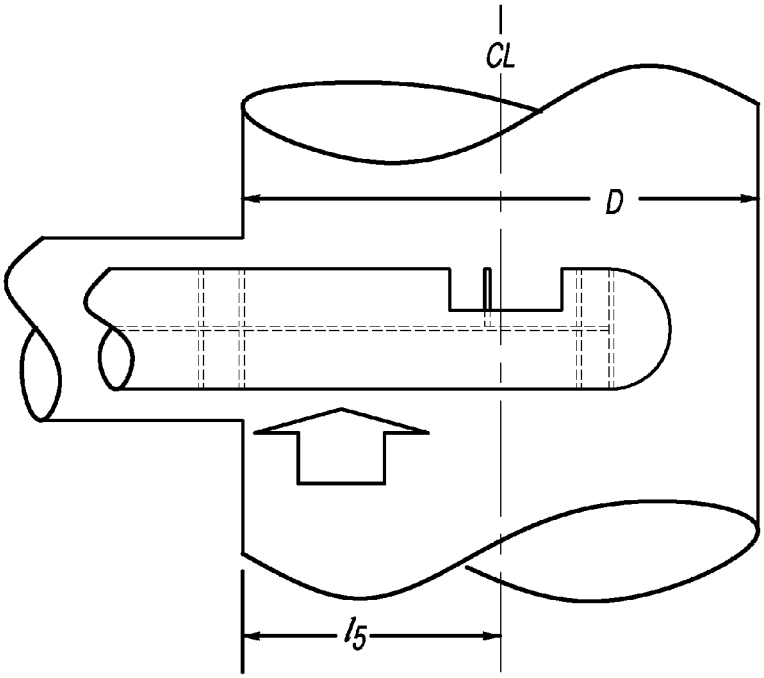
FIG. 6 is an enlarged side view of an injector nozzle and main pipe arrangement depicting dimension variables of the injector nozzle.
Figure 7:
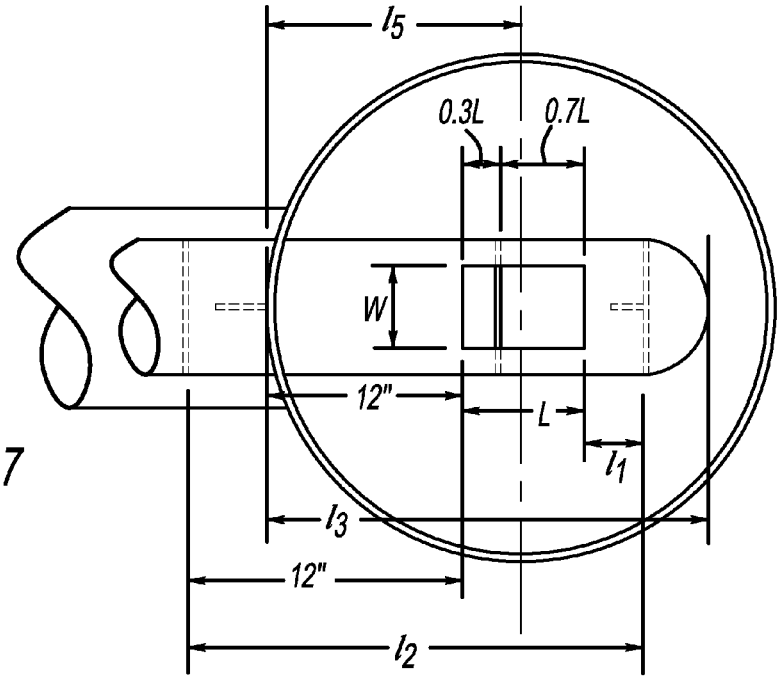
FIG. 7 is an enlarged side view of an injector nozzle and main pipe arrangement depicting dimension variables of the injector nozzle.

FIG. 6 depicts the same view as FIG. 4, and FIG. 7 depicts the same view as FIG. 5, except that for both FIGS. 6 and 7, example dimension variables are displayed, which may be used when employing injection system 10 in accordance with the present teachings. Dimension variables of FIG. 6 and FIG. 7 correspond to those noted below in Table 1 and Table 2. Generally, dimensions are provided for injection tube sizes from nominal 2 inches through 8 inches and sizes of main pipe 12 from nominal 10 inches through 24 inches. Dimensions are applicable to schedule 80 pipe.

In accordance with the present teachings, dimensions of injection system 10 components as depicted in FIGS. 6 and 7 may be in accordance with Table 1, below.

TABLE 1

Layout Dimensions (Schedule 80 Pipe Basis)

| Main Nom. Pipe Size, in | ID = D, in | OD, in | Injection Tube Nom. Size, in | $l_5$, Main ID to CL, in | $l_3$, Main ID to End of Pipe Cap, in |
|---|---|---|---|---|---|
| 10 | 9.562 | 10.750 | 2 | 4.781 | 7.781 |
| | | | 3 | 4.781 | 9.206 |
| | | | 4 | 4.781 | 10.561 |
| 12 | 11.750 | 12.750 | 2 | 5.875 | 8.875 |
| | | | 3 | 5.875 | 10.300 |
| | | | 4 | 5.875 | 11.655 |
| 14 | 12.500 | 14.000 | 2 | 6.250 | 9.250 |
| | | | 3 | 6.250 | 10.675 |
| | | | 4 | 6.250 | 12.030 |
| 16 | 14.312 | 16.000 | 2 | 7.156 | 10.156 |
| | | | 3 | 7.156 | 11.581 |
| | | | 4 | 7.156 | 12.936 |
| | | | 5 | 7.156 | 14.521 |
| 18 | 16.124 | 18.000 | 2 | 8.062 | 11.062 |
| | | | 3 | 8.062 | 12.487 |
| | | | 4 | 8.062 | 13.842 |
| | | | 5 | 8.062 | 15.427 |
| | | | 6 | 8.062 | 16.887 |
| 20 | 17.938 | 20.000 | 2 | 8.969 | 11.969 |
| | | | 3 | 8.969 | 13.394 |
| | | | 4 | 8.969 | 14.749 |
| | | | 5 | 8.969 | 16.334 |
| | | | 6 | 8.969 | 17.794 |
| 24 | 21.562 | 24.000 | 2 | 10.781 | 13.781 |
| | | | 3 | 10.781 | 15.206 |
| | | | 4 | 10.781 | 16.561 |
| | | | 5 | 10.781 | 18.146 |
| | | | 6 | 10.781 | 19.606 |
| | | | 8 | 10.781 | 22.526 |

In accordance with the present teachings, dimensions of injection system 10 components as depicted in FIGS. 6 and 7 may be in accordance with Table 2, below.

TABLE 2

Injection Tube Dimensions (Schedule 80 Pipe Basis)

| D Size, in | W, in | L, in | $l_1$, in | $l_2$, in |
|---|---|---|---|---|
| 2 | 1.50 | 2.00 | 1.00 | 15.00 |
| 3 | 2.32 | 2.85 | 1.50 | 16.35 |
| 4 | 3.06 | 3.76 | 1.90 | 17.66 |
| 5 | 3.85 | 4.73 | 2.50 | 19.23 |
| 6 | 4.61 | 5.65 | 3.00 | 20.65 |
| 8 | 6.10 | 7.49 | 4.00 | 23.49 |

Figure 8A:
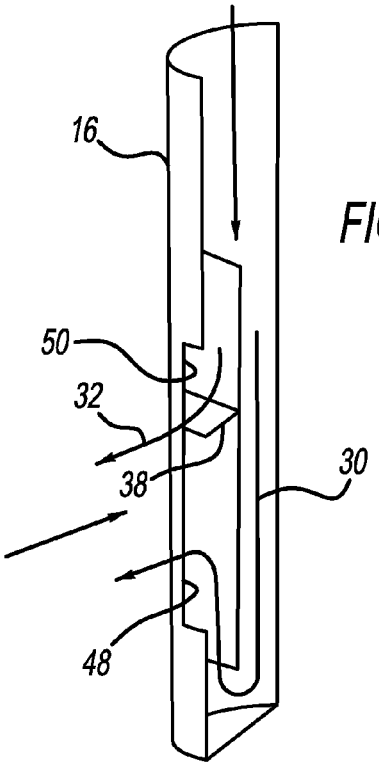
FIG. 8A is a perspective view of the injector nozzle depicting how a longitudinal baffle divides the fluid to a first baffle flow and a second baffle flow, each flow exiting via a different size opening in the injector nozzle.
Figure 8B:
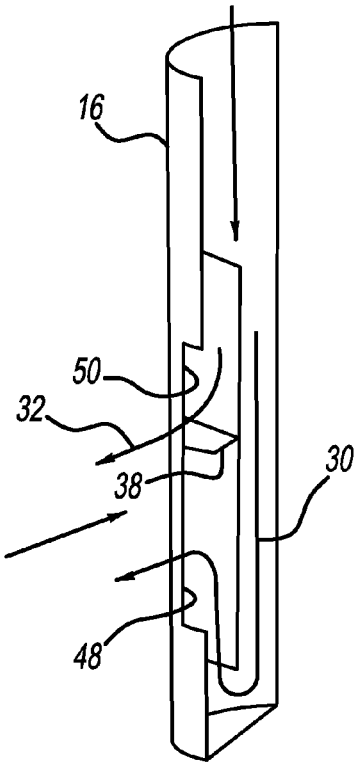
FIG. 8B is a perspective view of the injector nozzle depicting how a longitudinal baffle divides the fluid to a first baffle flow and a second baffle flow, each flow exiting via a different size opening in the injector nozzle.
Figure 8C:
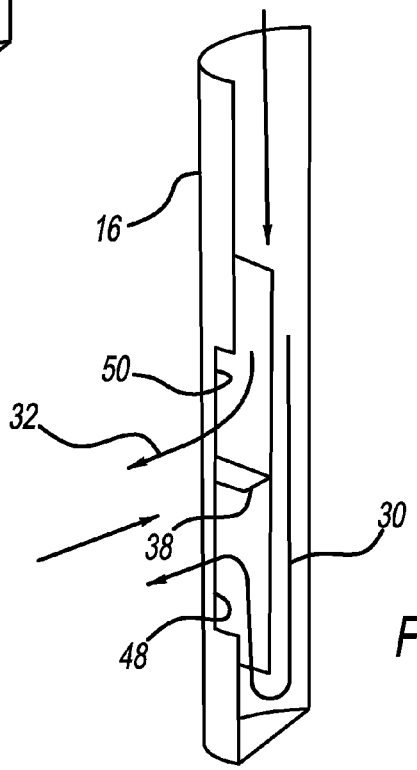
FIG. 8C is a perspective view of the injector nozzle depicting how a longitudinal baffle divides the fluid to a first baffle flow and a second baffle flow, each flow exiting via a different size opening in the injector nozzle.

FIGS. 8A, 8B and 8C depict three different size scenarios for first baffle flow outlet 68 and second baffle flow outlet 70. In order to clearly see interior longitudinal baffle 34 and transverse baffle 38, FIGS. 8A, 8B and 8C are cutaway perspective views. FIG. 8A depicts a 70:30 ratio of area of first baffle flow outlet 48 to an area of second baffle flow outlet 50, FIG. 8B depicts a 60:40 ratio of area of first baffle flow outlet 48 to an area of second baffle flow outlet 50, and FIG. 8C depicts a 50:50 ratio of area of first baffle flow outlet 48 to an area of second baffle flow outlet 50. Each of the structures of FIGS. 8A, 8B and 8C produce a different result or effect when employed in the current teachings.

Figure 9A:
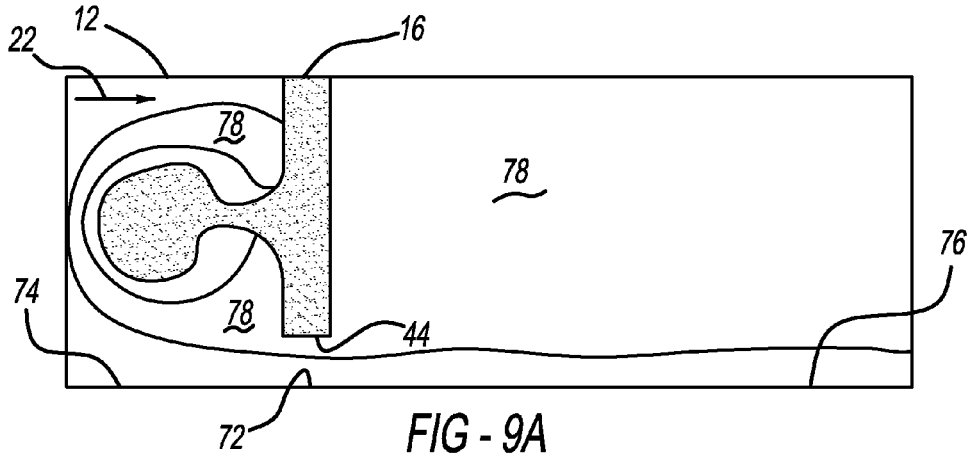
FIG. 9A is a thermal profile within the main pipe depicting temperatures around the injector nozzle during a double quench with a 70:30 injector nozzle outlet area.
Figure 9B:
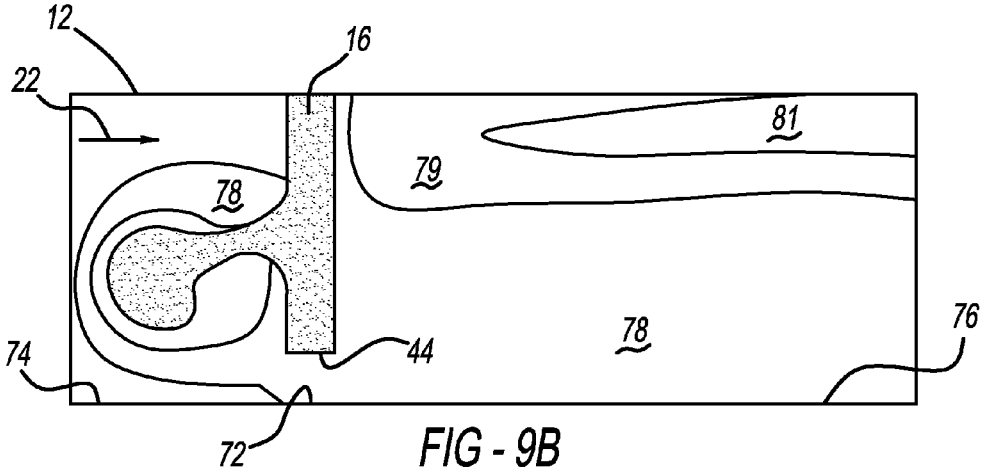
FIG. 9B is a thermal profile within the main pipe depicting temperatures around the injector nozzle during a double quench with a 60:40 injector nozzle outlet area.
Figure 9C:
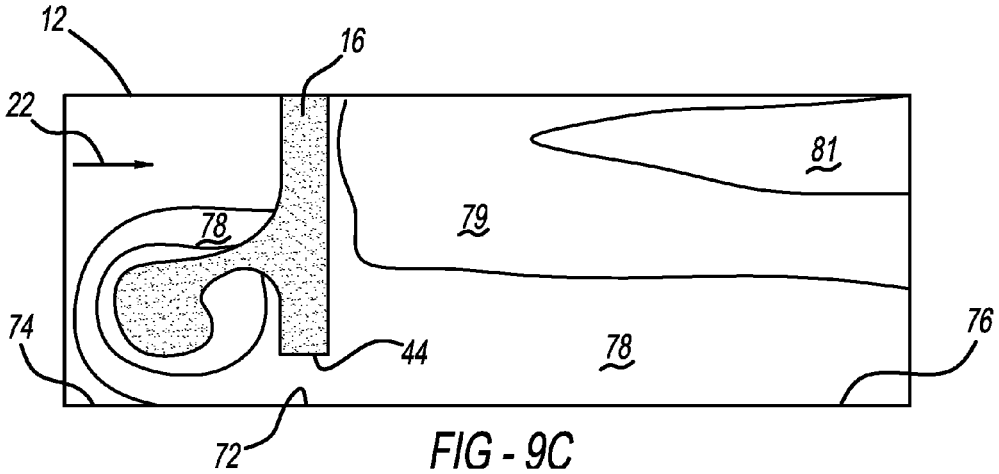
FIG. 9C is a thermal profile within the main pipe depicting temperatures around the injector nozzle during a double quench with a 50:50 injector nozzle outlet area.

FIGS. 9A, 9B and 9C depict results achieved when structures of FIGS. 8A, 8B and 8C are employed, respectively, in a counter-current arrangement, as depicted in FIG. 2, with injection from injector pipe 16 being set at a double quench rate. A normal or standard quench flow rate may be 9,503 lb/hr, and a double quench rate being discharged from injector pipe 16 into main pipe 12 is, or may be about, 19,006 lb/hr. FIG. 9A depicts a temperature profile within main pipe 12 when the ratio of area between first baffle flow outlet 48 and second baffle flow outlet 50 is 70:30 or 70% and 30%, respectively. FIG. 9A depicts an arrangement such that the same constant temperature is maintained at an upstream main pipe wall location 74, at a downstream main pipe wall location 76, and at a far-side interior wall location 72 of main pipe 12. Zones 78 are at a significantly cooler temperature than locations 72, 74 and 76, Far-side interior wall location 72 of main pipe 12 is referred to as such because it is a location at an interior wall of main pipe 12 that is opposite or opposed to injector pipe 16. Injector pipe 16 can be thought of passing through its near-side wall. Far-side interior wall location 72 of main pipe 12 is also the closest interior main pipe wall location relative to end cap 44 of injector pipe 16. As depicted in FIGS. 9A, 9B and 9C, a space or gap exists between end cap 44 of injector pipe 16 and far side interior wall location 72. Thus, as depicted in FIG. 9A, the temperatures at locations 72, 74 and 76 are the same or largely the same, which indicates that no thermal impingement of consequence occurs. In other words, thermal impingement is negligible along an interior wall location of main pipe 12 opposite injector pipe 16. Thus, cooling of fluid within main pipe 12 may be achieved, as evidenced by the higher temperature at upstream main pipe wall location 74 and lower temperature at midstream-downstream location 78, while preventing thermal impingement to a large degree along a length of main pipe 12 downstream of injector pipe 16.

FIG. 9B depicts a temperature profile within main pipe 12 when the ratio of area between first baffle flow outlet 48 and second baffle flow outlet 50 is 60:40 or 60% and 40%, respectively. As also depicted in FIG. 9B, a constant temperature is not maintained at an upstream main pipe wall location 74, at a downstream main pipe wall location 76, and at a far-side interior wall location 72 of main pipe 12. More specifically, the temperature at upstream main pipe wall location 74 is higher than the temperature at far-side interior wall location 72. The temperature at far-side interior wall location 72, may be slightly higher than the temperature at downstream main pipe wall location 76 since location 72 is a temperature transition zone. Thus, some thermal impingement occurs when a 60:40 area ratio of outlet 36 is utilized, although such thermal impingement is low and inconsequential. Zone 79 and zone 81 are increasing higher in temperature than zones 78 and similar to or the same as a fluid temperature upstream of injector pipe 16, where no mixing occurs. Thus, impingement is limited to location 72 and location 76, yet prevalent.

FIG. 9C depicts a temperature profile within main pipe 12 when the ratio of area between first baffle flow outlet 68 and second baffle flow outlet 70 is 50:50 or 50% and 50%, respectively. With areas of outlets 68, 70 being equal, as depicted in FIG. 9B, a constant temperature is not maintained at an upstream main pipe wall location 74, at a downstream main pipe wall location 76, and at a far-side interior wall location 72 of main pipe 12. More specifically, the temperature at upstream main pipe wall location 74 is higher than the temperature at far-side interior wall location 72, which appears to be the same or higher to a miniscule degree than the temperature at downstream main pipe wall location 76. Because a constant temperature is not maintained at an upstream main pipe wall location 74, at a downstream main pipe wall location 76, and at a far-side interior wall location 72 of main pipe 12, impingement to a larger degree than in FIGS. 9A and 9B occurs. More specifically, the temperature at upstream main pipe wall location 74 is higher than the temperature at far-side interior wall location 72. The temperature at far-side interior wall location 72 is the same as the temperature at downstream main pipe wall location 76. Thus, thermal impingement occurs when a 50:50 area ratio of outlet 36 is utilized. Zone 79 and zone 81 are increasingly higher in temperature than zones 78 and similar to or the same as a fluid temperature upstream of injector pipe 16, where no mixing occurs. Thus, impingement occurs along main pipe 12 from upstream of location 72 to past location 76.

Figure 10A:
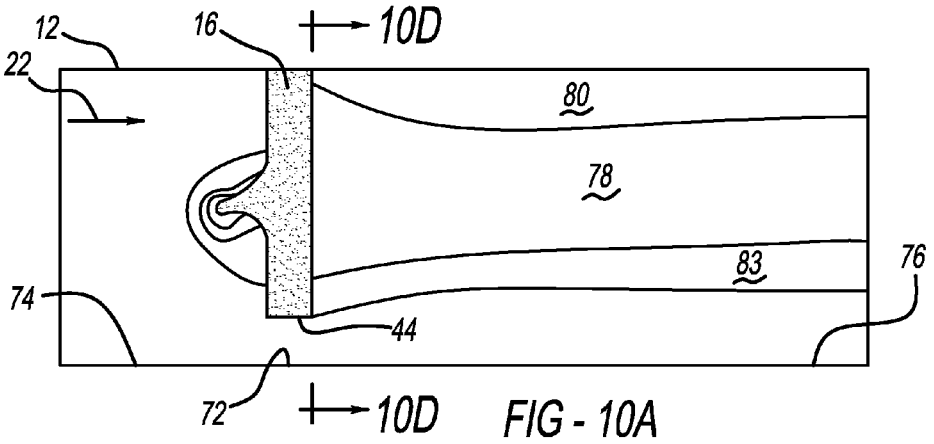
FIG. 10A is a thermal profile within the main pipe depicting temperatures around the injector nozzle during a half quench with a 70:30 injector nozzle outlet area.
Figure 10B:
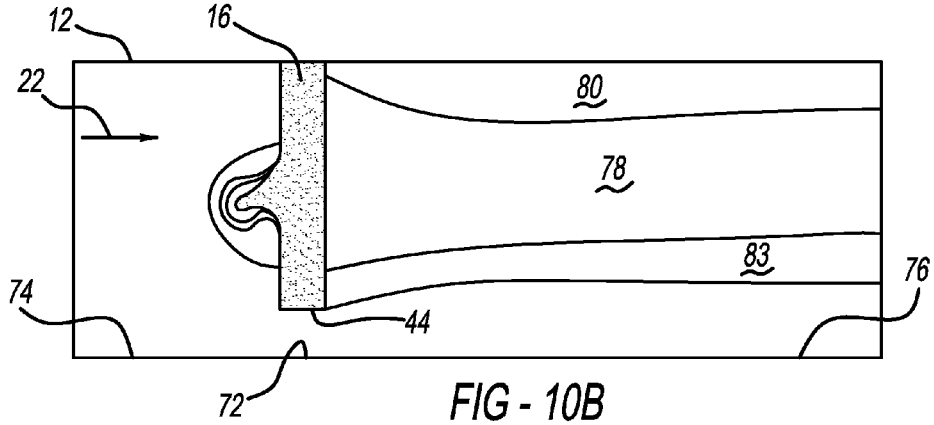
FIG. 10B is a thermal profile within the main pipe depicting temperatures around the injector nozzle during a half quench with a 60:40 injector nozzle outlet area.
Figure 10C:
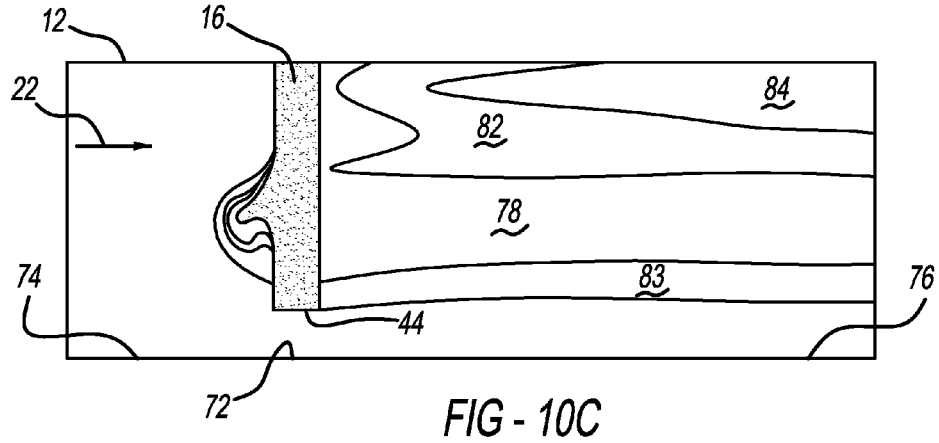
FIG. 10C is a thermal profile within the main pipe depicting temperatures around the injector nozzle during a half quench with a 50:50 injector nozzle outlet area.

FIGS. 10A, 10B and 10C depict results achieved when structures of FIGS. 8A, 8B and 8C are employed, respectively, in a half quench rate scenario. A normal or standard quench flow rate is 9,503 lb/hr, and therefore a half quench rate being discharged from injector pipe 16 into main pipe 12 is, or is about, 4,751.50 lb/hr. FIGS. 10A, 10B and 10C each depict temperature contours within main pipe 12 as injector pipe 16 injects cooler fluid into main pipe 12 in a counter-current arrangement. FIG. 10A depicts a temperature profile within main pipe 12 when the ratio of area between first baffle flow outlet 48 and second baffle flow outlet 50 is 70:30 or 70% and 30%, respectively. As depicted in FIG. 10A, a constant, non-quenched temperature is maintained at an upstream main pipe wall location 74, at a downstream main pipe wall location 76, and at a far-side interior wall location 72 of main pipe 12. As depicted in FIGS. 10A, 10B and 10C, a space or gap exists between end cap 44 of injector pipe 16 and far side interior wall location 72. Thus, as depicted in FIG. 10A, the temperature at locations 72, 74 and 76 is the same or largely the same, which indicates that no thermal impingement occurs as a result from an injection discharge from injector pipe 16. Thus, thermal impingement is negligible, along nearly an entire interior wall location of main pipe 12 opposite injector pipe 16. Thus, cooling of fluid within main pipe 12 may be achieved, as evidenced by the higher, non-quench temperature at upstream main pipe wall location 74 and relatively lower temperature at midstream-downstream location 78, while preventing thermal impingement along a length of main pipe 12 downstream and at an opposite side of main pipe 12 as injector pipe 16. Although downstream near side interior zone 80 in FIG. 10A experiences a slightly lower temperature compared to upstream location 74, such lower temperature is not significant enough to amount to a thermal impingement to cause undesirable cyclical thermal fluctuations in material of main pipe 12. Zone 80 is at a higher temperature than zone 78, but both are lower than the unmixed upstream temperature, such as at location 74, which is the same temperature as location 72 and location 76. As an example, a temperature difference between upstream location 74 and downstream, near side interior wall zone 80 may be 25 to 30 degrees Fahrenheit (approximately −4 to −1 degrees Celsius). In FIG. 10A, when the ratio of area between first baffle flow outlet 68 and second baffle flow outlet 70 is 70:30, the temperatures of upstream main pipe wall location 74, far side interior wall location 72, and downstream main pipe wall location 76 may be equal, as they are all depicted in the same temperature zone. Temperature zone 83 may be the same temperature as temperature zone 80.

FIG. 10B depicts a temperature profile within main pipe 12 when the ratio of area between first baffle flow outlet 48 and second baffle flow outlet 50 is 60:40 or 60% and 40%, respectively. As depicted in FIG. 10B, the thermal contours or zones are very similar to the thermal contours of FIG. 10A. That is, a constant temperature contour is maintained at an upstream main pipe wall location 74, at a downstream main pipe wall location 76, and at a far-side interior wall location 72 of main pipe 12. Thus, as depicted in FIG. 10B, the temperature at locations 72, 74 and 76 is the same or largely the same, which indicates that no thermal impingement occurs as a result from a discharge from injector pipe 16. Thus, thermal impingement is negligible, along an entire interior wall location of main pipe 12 opposite injector pipe 16 at location 72 and in near side thermal zone 80. Thus, cooling of fluid within main pipe 12 may be achieved, as evidenced by the higher temperature at upstream main pipe wall location 74 and lower temperature at midstream-downstream zone 78, while preventing consequential thermal impingement along a length of main pipe 12 downstream of injector pipe 16. Although downstream near side interior wall zone 80 in FIG. 10B experiences a slightly lower temperature compared to upstream location 74, such lower temperature is not significant enough to amount to a thermal impingement to cause undesirable cyclical thermal fluctuations in main pipe 12. As an example, a temperature difference between upstream location 74 and downstream, near side interior wall location 80 may be 25 or 30 degrees Fahrenheit (approximately −4 to −1 degrees Celsius). In FIG. 10B, when the ratio of area between first baffle flow outlet 48 and second baffle flow outlet 50 is 60:40, the temperatures of upstream main pipe wall location 74, far side interior wall location 72, and downstream main pipe wall location 76 may be equal, as they are all depicted in the same temperature zone.

FIG. 10C depicts a temperature contour within main pipe 12 when the ratio of area between first baffle flow outlet 48 and second baffle flow outlet 50 is 50:50 or 50% and 50%, respectively. With areas of outlets 48, 50 being equal, as depicted in FIG. 8C, FIG. 10C depicts how a constant temperature is maintained at an upstream main pipe wall location 74, at a downstream main pipe wall location 76, and at a far-side interior wall location 72 of main pipe 12. Multiple temperature zones exist across a cross section of main pipe 12 downstream from injector pipe 16, from downstream main pipe wall location 76 to an opposite interior wall temperature zone 84. As examples, at downstream main pipe wall location 76, the temperature recorded measured 692 degrees Fahrenheit (367 degrees Celsius). Upon moving toward a center of main pipe 12, the temperature at downstream temperature zone 78 may be 586 degrees Fahrenheit (308 degrees Celsius). As depicted in FIG. 10C, downstream temperature zone 78 may be downstream of injector pipe 16 yet inline with openings 48, 50 (proximate the centerline of main pipe 12) that open in the upstream direction. The thermal contour continues radially outward downstream from injector pipe 16, such as from a centerline position of main pipe 12. Thus, in FIG. 10C, locations 72, 74 and 76 within the same zone are at the highest temperature and equal to a temperature of fluid 22 before encountering mixing at injector pipe 16, temperature zone 84 is next highest in temperature followed by temperature zone 82 and then temperature zone 78, which is the lowest temperature zone.

Figure 10D:
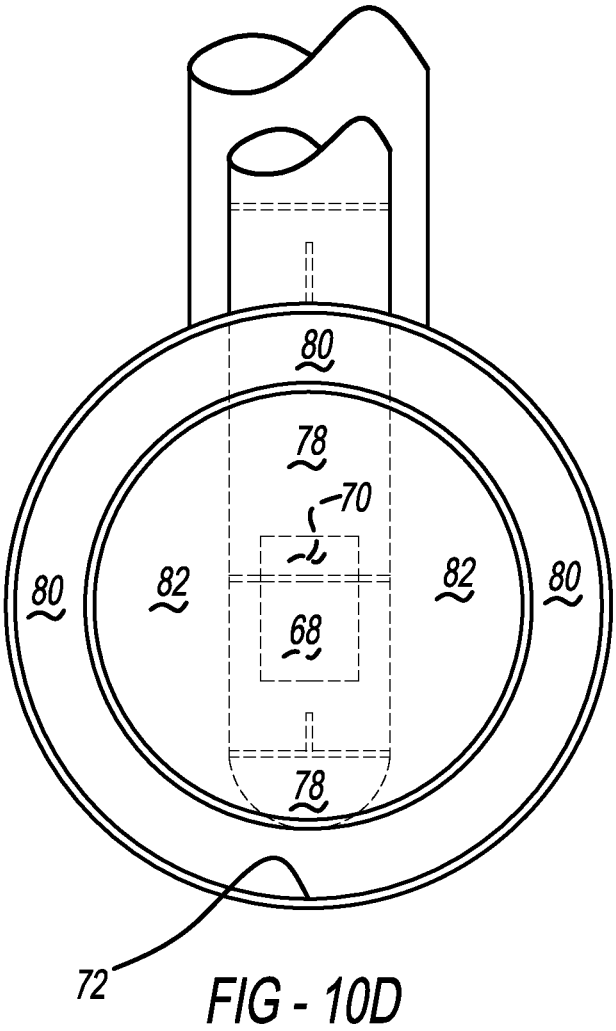
FIG. 10D is a cross-sectional thermal contour plot of main pipe taken immediately downstream of the injector pipe.

FIG. 10D is a transverse cross-sectional view of main pipe 12 taken at line 10D-10D of FIG. 10A, for a half quench rate. Injector pipe 16 is depicted with phantom lines in FIG. 10D to provide perspective of how the thermal plot exists relative to injector pipe 16 when configured with 70:30 area distribution of outlet 36. Temperature zones 80 indicate a temperature of about 665 degrees Fahrenheit (351 degrees Celsius), temperature zones 82 indicate a temperature of about 532 degrees Fahrenheit (278 degrees Celsius), and far side interior wall location 72 indicates a temperature of about 692 degrees Fahrenheit (367 degrees Celsius). Because the temperature at far side interior wall location 72 is the same as the temperature upstream of injector pipe 16 before mixing, no thermal impingement occurs at far side interior wall location 72. Because little temperature differential is evident between location 80, which is 665 degrees Fahrenheit (351 degrees Celsius), and the temperature upstream of injector pipe 16, which is 692 degrees Fahrenheit (367 degrees Celsius), no significant thermal impingement occurs.

Figure 11:
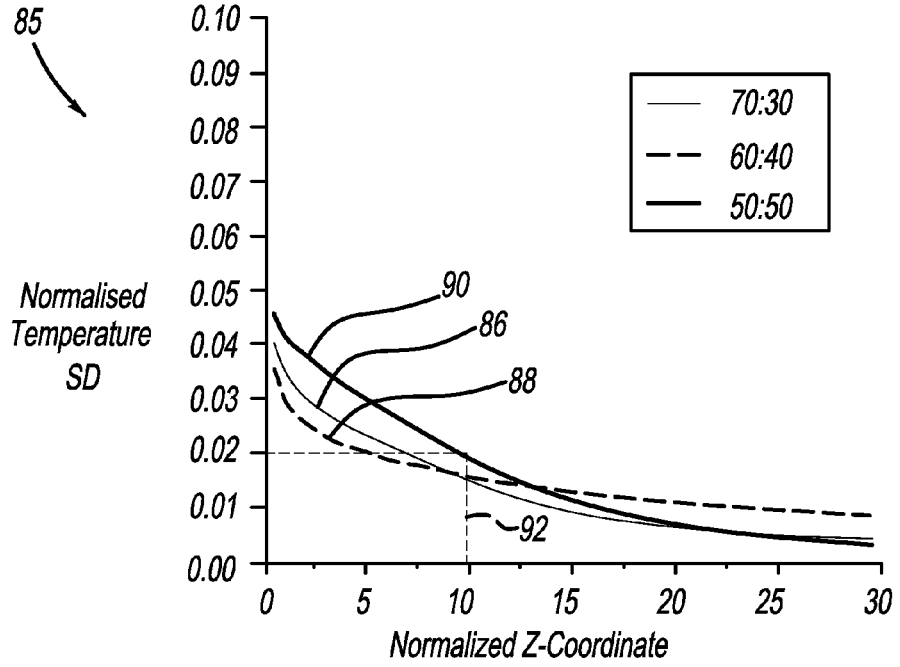
FIG. 11 is a graph depicting normalized temperature standard deviation versus the number of pipe diameters downstream from the injector nozzle that such temperatures are measured, for a double quench flow rate.

FIG. 11 depicts a graph 85 of normalized temperature standard deviation versus the number of main pipe diameters downstream from injector nozzle 16 that such temperatures were measured. Graph 85 portrays a 70:30 plot 86, a 60:40 plot 88 and a 50:50 plot 90, all for double quench flow rates. Plots 86, 88 and 90 overlay a target box 92, which is a target box where the standard deviation falls below 2% of the mean within ten diameters downstream of injector pipe 16. The X-axis is a normalized Z-coordinate that represents the number of diameters of main pipe 12 downstream of injector pipe 16 that a temperature was measured. Target box 92 is a target within which plots are desired to pass through to achieve desired performance results. As depicted, 70:30 plot 86 and 60:40 plot 88 pass through target box 92, and thus achieve the most advantageous results, while 50:50 plot 90 passes through a corner of target box 92.

Figure 12:
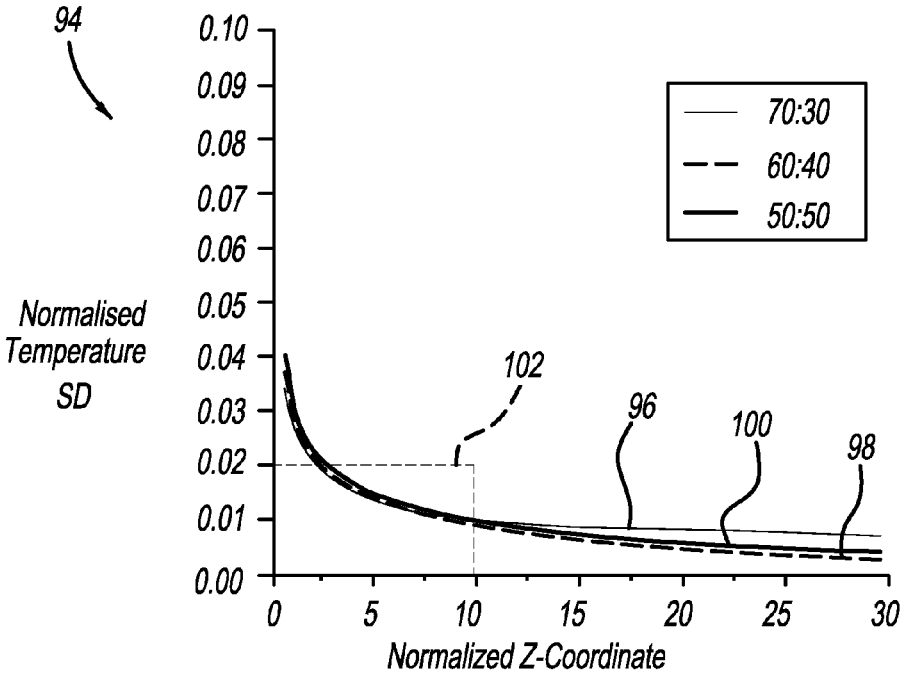
FIG. 12 is a graph depicting normalized temperature standard deviation versus the number of pipe diameters downstream from the injector nozzle that such temperatures are measured, for a half quench flow rate.

FIG. 12 depicts a graph 94 of normalized temperature standard deviation versus the number of main pipe diameters downstream from injector nozzle 16 that such temperatures were measured. Graph 94 portrays a 70:30 plot 96, a 60:40 plot 98 and a 50:50 plot 100, all for half quench flow rates. Plots 96, 98 and 100 overlay a target box 102, which is a zone where the standard deviation falls below 2% of the mean within ten diameters downstream of injector pipe 16. The X-axis is a normalized Z-coordinate that represents the number of diameters of main pipe 12 downstream of injector pipe 16 that a temperature was measured. Target box 102 is a target within which plots are desired to pass through to achieve desired performance results. As depicted, 70:30 plot 96, 60:40 plot 98 and 50:50 plot 100 pass through target box 92, and thus achieve advantageous results.

There are multiple advantages of the teachings of the disclosure. One advantage is that by dividing outlet 36 into first baffle flow outlet 68 and second baffle flow outlet 70, discharges from outlets 48, 50 impinge each other to facilitate mixing of a relatively colder fluid into a relatively hotter fluid without impinging a wall of main pipe 12, Because pipe walls will not be impinged or directly struck with a colder fluid, the service life of metal pipes will be increased, and maintenance downtime and replacement costs may be lowered. Injector pipe 16 may perform best in a horizontal or vertically rising portion of main pipe 12. Fluid 26 of injector pipe 16 may be a single phase or mist to be easily divided and may flow at 75-100 feet per second (23-30 meters per second). 100 feet per second (30 meters per second) may be the maximum flow rate through injector pipe 16.

The metallurgy of the injector pipe 16 may be adjusted according to service conditions such as temperature, fluid use, etc. Injector pipe 16 may be a minimum of schedule 40 pipe, and may be schedule 80 pipe. Outlet 36 may be centered with longitudinal centerline 20 in main pipe 12 in injection system 10. Width of outlet 36 may be 80% of the inside diameter of injector pipe 16, and the length of outlet 36 may be Pi (approximately 3.14) times the width of outlet 36.

Thus, without sacrificing mixing efficiency, the present teachings impart minimal thermal stresses in main pipe 12 due to minimal impingement of a relatively cold fluid 26 from injector pipe 16 into fluid 22 and interior wall of main pipe 12. While there may be many injector arrangement scenarios to prevent impingement of a relatively cold fluid 26 from injector pipe 16 against a wall of main pipe 12, such arrangements have an adverse effect on mixing efficiency when characterized by standard deviation of temperature as a function of downstream distance, as previously explained. In other words, the thermal profiles of other scenarios within main pipe 12 are not advantageous. For example, there are ways to achieve more thorough mixing, but such ways result in direct impingement of a relatively cold fluid within walls of a pipe into which injection is made. The present teachings eliminate or minimize direct thermal impingement without compromising mixing efficiency of a relatively cold fluid 26 from injector pipe 16 into a relatively hotter fluid 22 within main pipe 12. Another advantage of the injector system of the present teachings is its thermal and mixing effectiveness when injector pipe 16 discharges at different quench rates, which have been previously discussed. Moreover, the present teachings are applicable to vapor injection from injector pipe 16 and two-phase liquid-vapor mixture in main pipe 12. During analysis, a two-phase mixture in main pipe 12 contained less than 1% liquid by volume when injector pipe injected a 100% vapor stream. Thus, the present teachings are applicable for a vapor-vapor system, that is, from 99%-100% vapor from injector pipe 16 into a 100% vapor stream within main pipe 12.

Thus, an injection system 10 may include a first hollow pipe 12 for carrying, directing or containing a first fluid, and a second hollow pipe 16 for carrying, directing or containing a second fluid to be injected into first hollow pipe 12. The second hollow pipe 16 passes through a wall (i.e. hole 14 in the wall) of first hollow pipe 12 to approximately a centerline 20 of first hollow pipe 12. Second hollow pipe 16 may have an end cap 44 that protrudes beyond centerline 20 of first hollow pipe 12. Second hollow pipe 16 may reside through a wall of first hollow pipe 12 with outlet 36 residing proximate a centerline 20 of first hollow pipe 12. Second hollow pipe 16 may define an outlet in a sidewall to permit the second fluid to flow from second hollow pipe 16 and into the first fluid of first hollow pipe 12. Longitudinal baffle 34 may reside within second hollow pipe 16. Longitudinal baffle 34 within second hollow pipe 16 may extend through a sidewall of first hollow pipe 12 to beyond or past centerline 20 of first hollow pipe 12. Longitudinal baffle 34 may divide the first fluid into a first baffle flow (e.g. a flowing fluid) 30 and a second baffle flow 32 (e.g. a flowing fluid). That is, a first baffle flow (i.e. a fluid flow path) flows along a first side of the longitudinal baffle and the second baffle flow (i.e. a fluid flow path) flows along a second side of the longitudinal baffle. The injection system 10 may farther include a transverse baffle 38 that is attached to the longitudinal baffle 34. Transverse baffle 38 may be arcuate and may protrude into the outlet. The transverse baffle 38 may have a partial peripheral profile that is the same as a peripheral profile of first hollow pipe 12. Transverse baffle 38 may divide outlet 36 (i.e. the outlet) into a first baffle flow outlet 48 for the first baffle flow and a second baffle flow outlet 50 for the second baffle flow. Transverse baffle 38 may further define two surfaces 52, 53 that are parallel to each other and that are perpendicular to surfaces 40, 42 of longitudinal baffle 34. End cap 44 may enclose a tip end 46 of transverse baffle 38. First baffle flow 30 may occur between end cap 44 and longitudinal baffle 34. An area of the first baffle flow outlet 48 may be greater than 50 percent of an area of outlet 36 and an area of the second baffle flow outlet 50 may be less than 50 percent of the area of outlet 36. Alternatively, an area of the first baffle flow outlet 48 may be 70 percent of the area of outlet 36 and an area of second baffle flow outlet 50 may be 30 percent of the opening. The transverse baffle 38 may have a partial peripheral profile (e.g. an arcuate profile) that may be the same as a peripheral profile (e.g. an arcuate profile) of the first hollow pipe 12.

It should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. An injection system comprising:

a first hollow pipe through which a first fluid flows;

a second hollow pipe through which a second fluid flows, wherein the second hollow pipe passes through a wall of the first hollow pipe proximate a centerline of the first hollow pipe;

wherein the second hollow pipe defines an opening in a sidewall to permit the second fluid to flow from the second hollow pipe and into the first fluid;

a longitudinal baffle within the second hollow pipe, wherein the longitudinal baffle within the second hollow pipe extends through the wall of the first hollow pipe to beyond a centerline of the first hollow pipe; and a transverse baffle that is attached to the longitudinal baffle, wherein the transverse baffle divides the opening into a first baffle flow outlet for a first baffle flow and a second baffle flow outlet for a second baffle flow and further wherein an area of the first baffle flow outlet is about 70 percent of the opening and an area of the second baffle flow outlet is about 30 percent of the opening.

2. The injection system according to claim 1, wherein the second hollow pipe further comprises an end cap that protrudes beyond the centerline of the first hollow pipe.

3. The injection system according to claim 1, wherein the longitudinal baffle divides the first fluid into a first baffle flow and a second baffle flow.

4. The injection system according to claim 1, wherein the transverse baffle is arcuate and protrudes into the opening.

5. The injection system according to claim 1, wherein the transverse baffle has a partial peripheral profile that is the same as a peripheral profile of the first hollow pipe.

6. An injection system comprising:

a first hollow pipe through which a first fluid flows;

a second hollow pipe through which a second fluid flows, the second hollow pipe defining an opening proximate an end of the second hollow pipe, the second hollow pipe residing through a wall of the first hollow pipe with the opening residing proximate a centerline of the first hollow pipe;

a longitudinal baffle residing within the second hollow pipe that defines a first baffle flow path and a second baffle flow path within the second hollow pipe for the second fluid;

a transverse baffle attached to the longitudinal baffle that divides the opening into a first baffle flow outlet and a second baffle flow outlet; and wherein an area of the first baffle flow outlet is about 70 percent of the opening and an area of the second baffle flow outlet is about 30 percent of the opening.

7. The injection system according to claim 6, wherein the transverse baffle further defines two surfaces that are parallel to each other and that are perpendicular to surfaces of the longitudinal baffle.

8. The injection injector system according to claim 6, further comprising an end cap that encloses the end of the second hollow pipe.

9. The injection system according to claim 6, wherein the first baffle flow path resides between the end cap and the longitudinal baffle.

10. An injection system comprising:

a first hollow pipe through which a first fluid flows;

a second hollow pipe through which a second fluid flows, the second hollow pipe defining an opening proximate an end of the second hollow pipe, the second hollow pipe residing through a wall of the first hollow pipe with the opening residing proximate a centerline of the first hollow pipe;

a longitudinal baffle residing within the second hollow pipe that defines a first baffle flow path and a second baffle flow path within the second hollow pipe for the second fluid;

a transverse baffle attached to the longitudinal baffle that divides the opening into a first baffle flow outlet and a second baffle flow outlet; and wherein an area of the first baffle flow outlet is about 70 percent of the opening and an area of the second baffle flow outlet is about 30 percent of the opening.

11. The injection system according to claim 10, wherein:

a first baffle flow flows along a first side of the longitudinal baffle and a second baffle flow flows along a second side of the longitudinal baffle, and the transverse baffle further defines two surfaces that are parallel to each other and that are perpendicular to surfaces of the longitudinal baffle.

12. The injection system according to claim 10, further comprising an end cap that encloses the end of the second hollow pipe, wherein the first baffle flow path resides between the end cap and the longitudinal baffle.

13. The injection system according to claim 10, wherein the transverse baffle has a partial peripheral profile that is the same as a peripheral profile of the first hollow pipe.

* * * * *